US006186555B1

(12) United States Patent
Rawlings

(10) Patent No.: US 6,186,555 B1
(45) Date of Patent: Feb. 13, 2001

(54) INVERTED SHELF TALKER SHEET

(75) Inventor: Timothy W. Rawlings, Waynesville, OH (US)

(73) Assignee: NCR Corporation, Dayton, OH (US)

( * ) Notice: Under 35 U.S.C. 154(b), the term of this patent shall be extended for 0 days.

(21) Appl. No.: 09/318,060

(22) Filed: May 25, 1999

(51) Int. Cl.[7] ..... B42D 15/00

(52) U.S. Cl. ..... 283/81; 283/105; 283/101; 283/56; 281/3.1

(58) Field of Search ..... 283/105, 101, 283/81, 79, 80, 36, 56, 211, 40; 281/2, 3.1, 9, 6, 12

(56) References Cited

U.S. PATENT DOCUMENTS

| | | | | |
|---|---|---|---|---|
| 1,689,444 | * | 10/1928 | Manshel | 283/105 |
| 2,755,576 | | 7/1956 | Golden . | |
| 3,290,809 | | 12/1966 | King . | |
| 3,753,305 | | 8/1973 | Mueh . | |
| 4,179,138 | | 12/1979 | Bogdanovic . | |
| 4,338,739 | | 7/1982 | Greenberger . | |
| 4,477,048 | | 10/1984 | Conway . | |
| 4,483,502 | | 11/1984 | Fast . | |
| 4,572,380 | | 2/1986 | Langwell . | |
| 4,693,441 | | 9/1987 | Conway . | |
| 4,718,627 | | 1/1988 | Fast et al. . | |
| 5,042,768 | | 8/1991 | Goldstein . | |
| 5,182,152 | * | 1/1993 | Ericson | 283/105 X |
| 5,332,265 | * | 7/1994 | Groess et al. | 283/56 |
| 5,585,156 | * | 12/1996 | Fontana | 283/105 X |
| 5,970,640 | | 10/1999 | Farrow . | |

OTHER PUBLICATIONS

FLEXcon, "A Retail Application Guide", pp. 1–10, Jul. 15, 1997.

U.S. Patent Application Serial No. 09/Unknown, filed concurrently herewith on May 25, 1999, entitled "Adhesive Shelf Talker", Docket No. 8075, by inventor Timothy W. Rawlings, assigned to NCR Corporation.

* cited by examiner

*Primary Examiner*—Willmon Fridie, Jr.
(74) *Attorney, Agent, or Firm*—Franics L. Conte

(57) ABSTRACT

A shelf talker sheet includes a plurality of labels arranged head-to-head in a common sheet along a separation line. Each label has printing thereon inverted on opposite sides of the separation line.

18 Claims, 3 Drawing Sheets

INVERTED SHELF TALKER SHEET

BACKGROUND OF THE INVENTION

The present invention relates generally to product labels, and, more specifically, to shelf talkers.

Merchandising stores typically display on shelves different products with different prices. In a typical food market, for example, the shelves include a C-shaped metal bracket extending along the front edge thereof in which individual shelf product labels may be affixed for the corresponding products displayed.

A typical shelf label is in the form of a small pressure sensitive label, with the adhesive thereon typically providing permanent retention of the label within the shelf bracket itself. Alternatively, the shelf label may be bonded to a plastic insert or clip which itself is trapped in the shelf bracket at the designated location.

A shelf talker is a special type of product label typically used for promoting brand identity, units of measure, price comparisons, and special sale pricing and promotions. The shelf talker is typically larger than the permanent shelf label and is in addition thereto for increasing the visibility of products being promoted.

Shelf talkers are typically provided in groups of similar size on individual sheets for collectively printing the desired information thereon. Fixed information, such as store identification and product graphics, is typically pre-printed in large quantities of the sheets in any suitable manner during the production of the shelf talkers. Variable information, such as the specific product, size, and promotional price, may then be locally printed on each of the shelf talkers in a common sheet using a suitable printer such as thermal transfer, laser, or direct thermal printing.

Due to their temporary nature, shelf talkers must be easy to produce, install, and remove, as well as being durable enough to withstand their intended use. And, cost is a significant factor which affects shelf talker usage.

Shelf talkers have enjoyed years of successful use in this country in promoting shelf products. A typical shelf talker is formed entirely of card stock which is relatively inexpensive, is easily printed, and is sufficiently stiff for preventing undesirable curling when temporarily mounted to the shelf bracket. Mounting is typically accomplished by providing a central die-cut tab near the top of the card which permits the bottom of the tab and the top of the card to be trapped in corresponding top and bottom hooks of the shelf bracket. In this way, the card talker is mechanically retained in the shelf bracket, which is sufficient for its limited duration use.

However, the card talkers are therefore subject to being inadvertently removed from the shelf or slid therealong when hit by a customer.

This problem may be solved by using full label sheet shelf talkers which have also enjoyed years of successful commercial use in this country. This type of shelf talker includes a label sheet adhesively bonded to a release liner so that the top portion of the liner may be removed for adhesively bonding the top of the label to the shelf bracket. The typical adhesive provides a temporary bond with the bracket so that the label may be removed when desired. The adhesive also prevents inadvertent removal or sliding of the label on the bracket.

In both types of shelf talker sheets, on-site printing is limited by the capabilities of the specific printer being used. The typical printer cannot print along the four edges of a sheet due to minimum margin requirements. However, it is desirable to maximize the printing area of shelf talkers, which includes printing in the margins thereof.

Typical shelf talkers are therefore configured in their sheets with corresponding blank margin strips which are removed from the shelf talkers as they are installed to permit visible print fully to the talker edge. These margin strips are not printed due to the printer limitations, and are discarded as waste. This waste adds to cost, and decreases the useful area of the individual shelf talkers.

Accordingly, it is desired to provide an improved shelf talker which reduces waste due to printer limitations.

BRIEF SUMMARY OF THE INVENTION

A shelf talker sheet includes a plurality of labels arranged head-to-head in a common sheet along a separation line. Each label has printing thereon inverted on opposite sides of the separation line.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
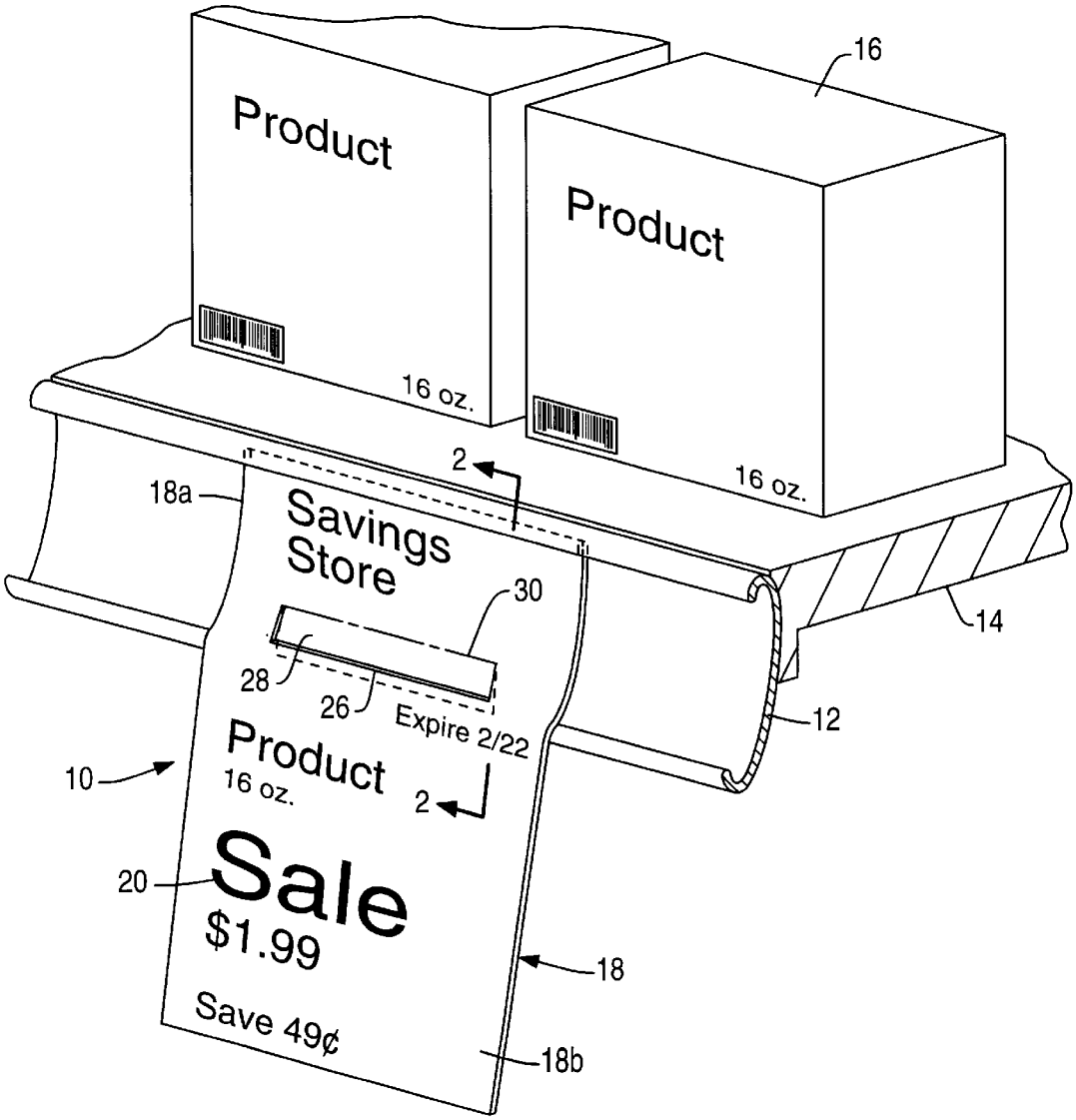
FIG. 1 is an isometric view of a portion of an exemplary shelf containing products thereon, with a shelf bracket supporting a shelf talker in accordance with an exemplary embodiment of the present invention.

Illustrated in FIG. 1 is an exemplary display tag or shelf talker 10 removably mounted to a shelf bracket 12 disposed along the front edge of a display shelf 14 in accordance with an exemplary embodiment of the present invention. The shelf talker 10 is typically provided to identify a special promotion of a corresponding product 16 displayed in groups atop the shelf 14, such as in a typical grocery store or supermarket.

The bracket 12 and shelf 14 may take any conventional form such as those illustrated. The typical bracket 12 is a metal extrusion which is C-shaped in cross section, with top and bottom J-hooks. The bracket is sized for receiving standard product shelf labels (not shown) which permanently designate the location of the shelf space reserved for a given product. A typical shelf label is a narrow pressure sensitive label configured for being adhesively bonded within the height of the shelf bracket, with a suitable length therein. The shelf label typically identifies the product, and may also include its regular price.

In a typical sale promotion of an individual product, it is desirable to use a corresponding shelf talker 10 which is typically larger in size than the shelf label and is temporarily mounted to the bracket for promoting the product.

As shown in FIG. 1, the shelf talker 10 may have any suitable size and configuration, and is typically rectangular.

The shelf talker includes a label 18 having a front side for promoting the product and an opposite back side for attachment to the bracket. The label includes a rectangular top strip 18*a* which extends horizontally across the full width of the label and is integrally joined to a rectangular bottom leaflet 18*b* in a preferably unitary, one-sheet configuration.

The label is sized and configured for printing atop the front thereof any desired printing 20, such as product information describing or promoting the specific products. In the exemplary embodiment illustrated in FIG. 1, the label identifies the name of the particular store, the particular product, and a promotional sale price therefor for promoting a temporary price reduction. Other descriptions or promotions as desired may be printed atop the label 18.

Figure 2:
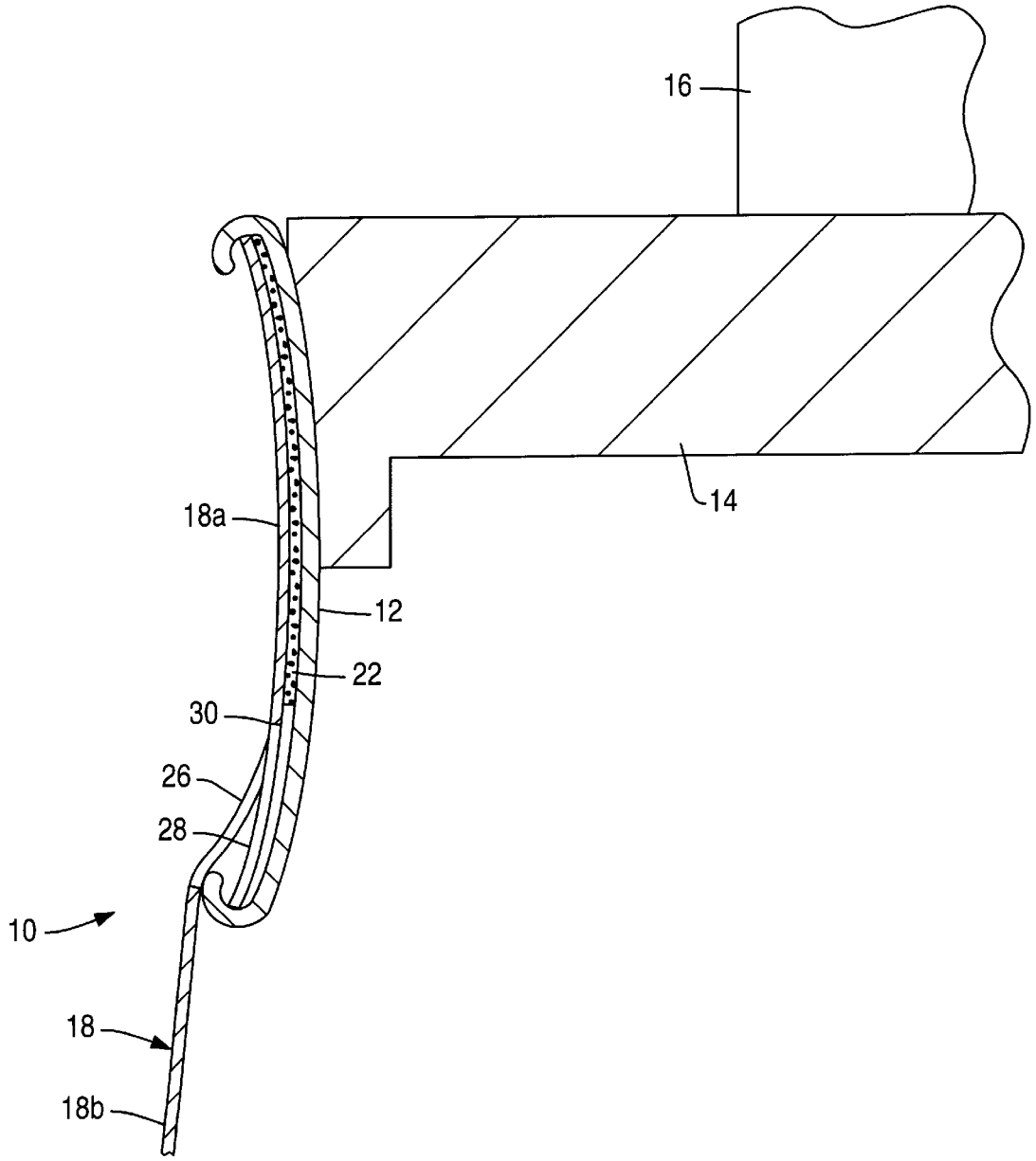
FIG. 2 is an elevational, cross sectional view of the shelf talker and bracket illustrated in FIG. 1 and taken along line 2—2.

If desired, the back of the top strip 18*a* may include a suitable adhesive 22 coated thereon for permitting the strip to be releasably bonded to the bracket 12 in the manner of a typical pressure sensitive label. FIG. 2 illustrates in cross section the strip 18*a* bonded to the bracket by the adhesive 22 for temporarily mounting the shelf talker 10 to the bracket, with the leaflet 18*b* typically being suspended downwardly.

Figure 3:
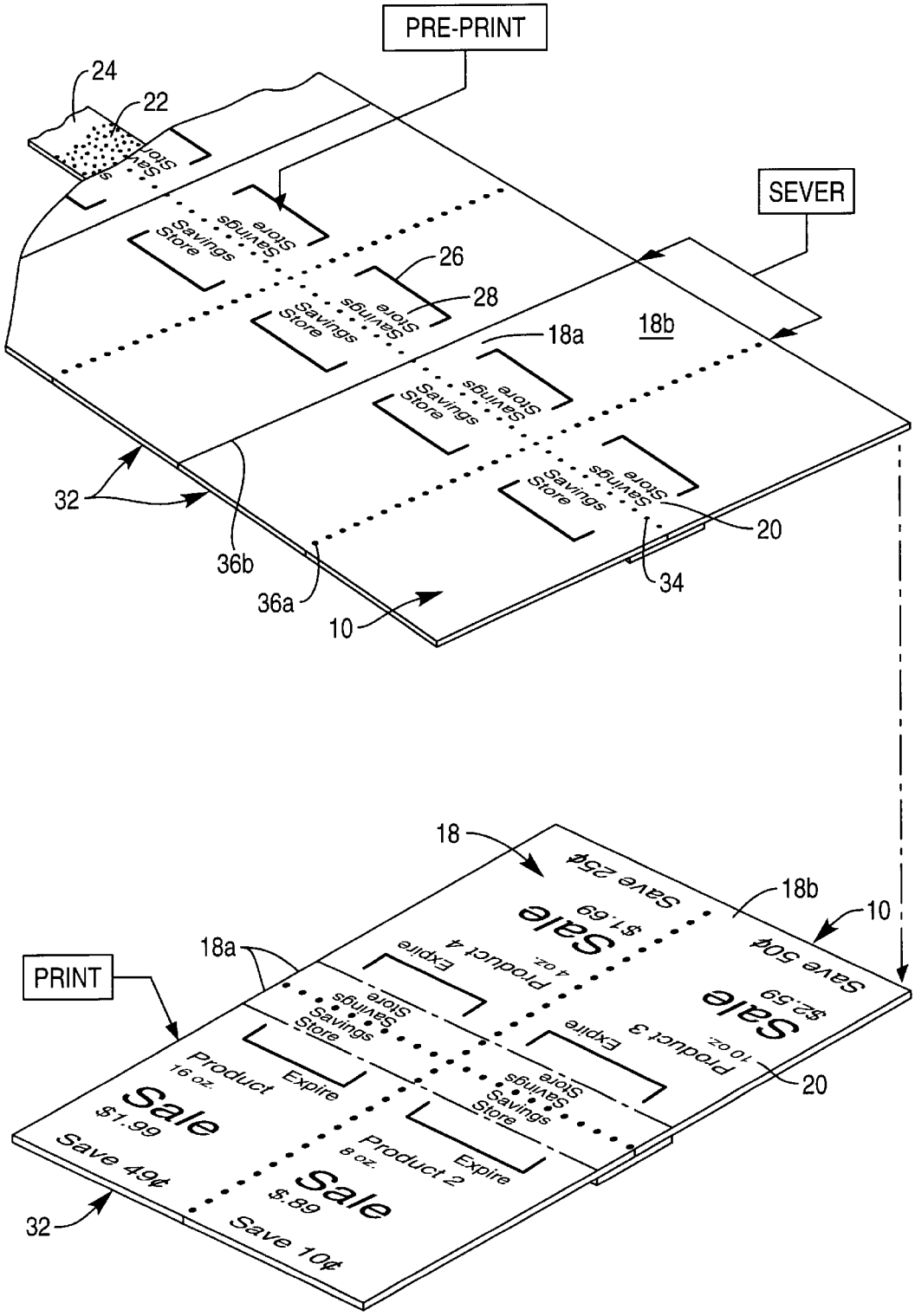
FIG. 3 is an isometric view of shelf talkers manufactured in groups in a series of common sheets, with a flowchart representation of an exemplary method of manufacturing the shelf talkers.

The shelf talker may be formed of conventional card stock, such as eight point (8 pt.), for suitable stiffness, with the adhesive being applied solely behind the top strip 18*a*. Or, the shelf talker may be a full label sheet, with adhesive across its entire back side. In both examples, a suitable release liner 24, as shown in FIG. 3, covers the adhesive until it is removed to mount the shelf talker to the shelf bracket.

To install the shelf talker, the liner is removed from the back of the label strip 18*a* by simply being peeled away therefrom. And, the label strip 18*a* may then be affixed to the shelf bracket illustrated in FIGS. 1 and 2 using the same adhesive 22 provided on the back of the strip, with the label then being supported by the bracket with its leaflet 18*b* being suspended downwardly for full view by passing customers.

Although the label 18 may be adhesively bonded by its top strip to the shelf bracket, the label is preferably also mechanically retained in the bracket as shown in FIGS. 1 and 2. More specifically, the label preferably includes a die cut 26 extending along three edges of a rectangle centrally between the top strip 18*a* and the leaflet 18*b* in a generally U-shape. The die cut 26 defines an integral rectangular tab 28 which extends horizontally and faces downwardly from the strip to the leaflet, and is bendable about an integral top hinge 30 which extends along the fourth edge of the rectangle defining the tab.

The tab is used for mechanically mounting the label to the bracket in the preferred embodiment. This is accomplished by bending the tab 28 along the hinge 30 to separate the three cut edges of the tab from the leaflet 18*b*. The liner is removed from the back of the strip 18*a* to expose the adhesive 22 hidden therebelow. The strip 18*a* and the tab 28, as best illustrated in FIG. 2, are inserted into the bracket 12 for supporting the leaflet 18*b* therefrom both mechanically and adhesively.

FIG. 3 illustrates schematically an exemplary method of manufacturing the shelf talkers 10 illustrated in FIGS. 1 and 2 arranged in a group or set thereof in a common sheet 32. In the exemplary embodiment illustrated, there are four shelf talkers arranged on an individual rectangular sheet 32 of standard size such as eight and a half by eleven inches. And, a series of the sheets 32 are initially formed side by side in a continuous sheet unwound from a roll. The liners 24 preferably bridge each sheet 32 from edge-to-edge along the narrower width thereof as opposed to its longer length.

In accordance with the present invention, the individual labels are disposed strip-to-strip or head-to-head in the sheet, with the respective liners 24 thereof adjoining each other. The liners 24 preferably define a common ribbon along the width of the sheet and along the running axis of the adjoining sheets for permitting liner application in a single strip along the center of the sheets. This may be accomplished in a conventional manner in which the sheet defining the labels is laminated with the liner ribbon by extruding the adhesive 22 therebetween in a continuous process as the sheets and liners are laminated along the running axis thereof.

The individual labels 18 and corresponding liners 24 may then be suitably severed at least in part to permit separation of individual ones of the shelf talkers from their neighbors in the common sheets. Severing may be accomplished in any conventional manner such as providing lines of perforations along the centers of the length and width of the common sheets 32, along which the individual shelf talkers may be separated by tearing. The individual tabs 28 may be provided by the corresponding die cuts 26 therefor.

Any desired product description or information 20 may be printed atop the strip 18*a* and leaflet 18*b* in any convenient manner. For example, fixed information may be preprinted atop the label during formation of the label sheets in a continuous process. The individual sheets 32 are then separated from each other and grouped in packages for use locally at particular retail stores. Local printing may then be used for the desired variable information on each of the individual shelf talkers as desired.

As shown schematically in FIG. 3, the shelf talkers are preferably formed in groups on common sheets 32 in a continuous process from a roll or web of material. The labels 18 are arranged head-to-head in each common sheet along a corresponding separation line 34.

In one embodiment, the labels are also arranged side-by-side on each sheet, with pairs of the labels being arranged head-to-head along the separation line. Four labels 18 are illustrated in FIG. 3 arranged in two side-by-side pairs, although other multiple label configurations greater than four, and at least two, may be used.

In conventional practice, the separation line 34 is a horizontal perforation line permitting the labels to be cleanly torn apart therealong. A similar vertical separation or perforation line 36*a* is used between label pairs to permit clean separation therealong. Adjacent label sheets 32 are preferably separated at die cuts 36*b* which permit precise dimension for the individual sheets 32 for group packaging.

The top strips 18*a* of the label pairs are oriented head-to-head or strip-to-strip along their separation lines 34 in each sheet. And, the corresponding leaflets 18*b* thereof extend to opposite ends of each sheet. The printing 20 may then be applied over the full label as desired, including its top strip and bottom leaflet. However, the printing 20 is inverted on the adjacent strips 18*a* along the separation line 34 to maximize the available surface area for printing.

By orienting the top strips in the middle of each sheet, printing may be applied thereto without concern or limit by the typical blank margins around the perimeter of the sheet when passed through a conventional printer. The printing may be applied to terminate at the separation line 34, without any blank margin thereat as desired. No sacrificial margin piece is therefore required along the top strips since those strips are located in the middle of the sheet.

In the exemplary method illustrated schematically in FIG. 3, the sheets may be formed from a continuous web, and individually severed therefrom by the vertical separation or side lines 36*b*. Each sheet 32 is further severed into the desired number of shelf talkers and corresponding labels by the horizontal separation line 34 and the vertical separation or interior line 36*a*.

The printing 20, or product information, is printed atop the labels and inverted on opposite sides of the separation line 34 to match the head-to-head orientation of the individual labels. Any conventional printing equipment may be used to print the inverted formats either in one pass, or in multiple inverted passes. The printing 20 may be printed up to the separation line 34 itself without limit by the blank perimeter margins of the sheet 32, except along the sides thereof.

The printing 20 may be performed either as pre-printing on the sheets as they are formed from the web, or post-printing locally at the final use site. Typically, fixed information such as store name and art graphics are pre-printed, and variable information such as the specific product and promotion are post-printed on site. In either case, the printing 20 may be applied over the entire top strips 18*a* of the adjoining labels without restriction by perimeter margins.

After complete printing of each label sheet 32, the individual labels 18 are separated therefrom by tearing along the lines 34 and 36*a* to form the individual shelf talkers 10.

The head-to-head label configuration illustrated in FIG. 3 permits a common release liner 24 to be bonded across the adjoining top strips 18*a* by the adhesive 22 laminated therebetween. This improves ease of manufacture, and reduces corresponding cost. And, since the adhesive need only be applied behind the top strips, additional adhesive and liner material behind the leaflets 18*b* may be avoided for further reducing cost. The small strip of liner 24 remaining behind each top strip 18*a* is readily peeled away prior to bonding the self talker to the shelf bracket.

As indicated above, each shelf talker may also be mechanically attached to the shelf bracket. This is readily accomplished by die cutting each label at its top strip 18*a* to form the respective tabs 28. The tabs 28 are deployed by bending them at their hinges 30 as shown in FIG. 1, with the tab being trapped in the bracket bottom hook, and the top edge of the label being trapped in the top hook.

The improved shelf talker sheet recovers printing area at the top of each label which would otherwise be lost if the top strips were positioned along the sheet perimeter. Sacrificial margin strips may therefore be eliminated to reduce waste. And, more printing area is available in each shelf talker along its top edge for enhancing promotional effect.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A shelf talker sheet for labeling a bracket on a shelf for promoting products thereon, comprising:

a plurality of labels arranged head-to-head in a unitary sheet along a cut separation line;

each of said labels including a top strip for being mounted to said shelf bracket, and a bottom leaflet extending from said top strip for being suspended downwardly from said shelf, and said top strips adjoin each other at said separation line for permitting said labels to be separated apart thereat:

an adhesive coating a back of said strips, and a release liner bonded to said labels across said adhesive strips; and each label having printing thereon inverted on opposite sides of said separation line for promoting said products atop said shelf.

2. A shelf talker according to claim 1 wherein:

said printing covers both said strip and leaflet; and said printing is inverted on adjacent strips along said separation line.

3. A shelf talker according to claim 2 wherein said printing terminates at said separation line.

4. A shelf talker according to claim 2 wherein each of said labels further includes a die cut between said strip and leaflet extending along three edges of a rectangle to define a tab bendable about a hinge along a fourth edge of said rectangle for mounting said label to said bracket.

5. A shelf talker according to claim 2 further comprising a plurality of said labels arranged side-to-side on said sheet, with pairs of said labels being arranged head-to-head along said separation line.

6. A method of making said shelf talker according to claim 2 comprising:

severing said common sheet into a plurality of labels along said separation line; and printing said printing atop said labels and inverted on opposite sides of said separation line.

7. A method according to claim 6 further comprising printing said printing up to said separation line.

8. A method according to claim 6 further comprising separating said labels from each other along said separation line into individual shelf talkers.

9. A method according to claim 6 further comprising die cutting said strips to define corresponding tabs thereat.

10. A shelf talker according to claim 2 wherein each of said labels further includes a die cut between said strip and leaflet extending along three edges of a rectangle to define a tab bendable about a hinge along a fourth edge of said rectangle for mounting said label to said bracket.

11. A shelf talker according to claim 10 further comprising:

a plurality of said labels arranged side-to-side on said sheet, with pairs of said labels being arranged head-to-head along said separation line; and said release liner defines a common ribbon running along the center of said sheet and includes said separation line therealong.

12. A shelf talker according to claim 11 wherein said adhesive is disposed solely behind said strips and not behind said leaflets.

13. A shelf talker according to claim 12 wherein said separation line is a perforation line.

14. A shelf talker according to claim 2 wherein said separation line is a perforation line.

15. A method of making said shelf talker according to claim 2 comprising:

arranging said labels head-to-head in said unitary sheet;

severing said sheet to form said separation line;

printing said printing atop said labels and inverted on opposite sides of said separation line; and then separating said labels from each other along said separation line into individual shelf talkers.

16. A method according to claim 15 further comprising:

perforating said sheet to form said separation line; and die cutting said strips to define corresponding tabs thereat.

17. A method according to claim 16 further comprising:

preprinting some of said printing atop said labels in a continuous roll of said unitary sheets;

separating said preprinted common sheets from each other; and printing the remainder of said printing atop said labels of said separated sheets.

18. A method according to claim 17 further comprising:

applying adhesive solely behind said top strips in said sheet roll; and applying a common ribbon release liner over said adhesive along said sheet roll.

* * * * *